US005782428A

United States Patent [19]

Chabot

[11] Patent Number: 5,782,428

[45] Date of Patent: Jul. 21, 1998

[54] ROLL HOLDER HAVING PIVOTING SUPPORT ARMS

[76] Inventor: Claude Chabot, 24612 Woodacre Ave., Hayward, Calif. 94544

[21] Appl. No.: 722,358

[22] Filed: Sep. 27, 1996

[51] Int. Cl.[6] ..... B65H 75/18

[52] U.S. Cl. ..... 242/596.8; 242/596.3

[58] Field of Search ..... 242/596.7, 596.8, 242/596.1, 596.3, 596

[56] References Cited

U.S. PATENT DOCUMENTS

| | | | |
|---|---|---|---|
| 1,651,867 | 12/1927 | Boynton | 242/596.7 X |
| 1,665,739 | 4/1928 | Hoegger . | |
| 1,687,819 | 10/1928 | Worthington . | |
| 1,778,282 | 10/1930 | Stewart | 242/596.7 X |
| 1,913,363 | 6/1933 | Allen | 242/596.7 X |
| 2,264,631 | 12/1941 | Fetty | 242/596.8 X |
| 2,801,131 | 7/1957 | Gauthier | 242/596.7 X |
| 2,896,871 | 7/1959 | Woodruff | 242/596.3 X |
| 2,948,486 | 8/1960 | Epeneter . | |
| 4,008,862 | 2/1977 | Wilmes | 242/596.3 X |
| 4,732,340 | 3/1988 | Toya | 242/596.3 |
| 4,858,840 | 8/1989 | Kidman | 242/596.3 |

OTHER PUBLICATIONS

P. 37 of a "Front Gate " catalog; Fall 1996 edition.

*Primary Examiner*—Daniel P. Stodola
*Assistant Examiner*—William A. Rivera
*Attorney, Agent, or Firm*—Gregory Scott Smith

[57] ABSTRACT

A device used to hold any material stored on or dispensed from a roll. The device comprises two shafts placed a given distance apart from each other and running substantially parallel to each other. A pivot structure is attached to the outer end of each shaft. The inner end of each shaft is fixed to a support structure such as a wall or cabinet. Support arms are fixed to the pivot structures at one end, and are oriented with the other end of the support arm pointing toward, and aligned on a common central longitudinal axis, with the support arm fixed to the pivot structure of the other arm. The support arms pivot only in a limited arc from horizontal to nearly perpendicular. Gravity tends to hold the arms in horizontal position. The roll is free to rotate on its central longitudinal axis on the support arms allowing a desired amount of material to be unrolled. The roll is removed by pushing the roll upward, causing the support arms to rotate upward and out of the central longitudinal aperture of the roll. The roll is installed by moving the roll upward against the support arms until top of the roll moves past the tips of the support arms, allowing the support arms to enter the central longitudinal aperture of the roll on each end. The roll is then allowed to move downward until the support arms are horizontal.

15 Claims, 4 Drawing Sheets

ROLL HOLDER HAVING PIVOTING SUPPORT ARMS

BACKGROUND OF THE INVENTION

1. Field of the Invention

The present invention relates to a roll holder which can be used to hold any material stored on or dispensed from a roll, including but not limited to toilet paper, tape, hand towels, plastic wrap, string, rope, cables and chain.

2. Description of the Prior Art

While the present invention is directed towards a roll holder which can be used to hold any material stored on or dispensed from a roll, the preferred embodiment of the present invention is for use for holding toilet paper rolls and paper towel rolls. Such discussion, however, should not be interpreted as limiting the use of this invention to toilet paper and paper towels rolls.

Conventional toilet paper roll holders and paper towel roll holders generally include an elongated base which is secured to a support structure such as a wall or cabinet, and two arms extend outwardly in parallel relation from opposite sides of the elongated base, which arms include a means for engaging the opposite ends of the central longitudinal aperture of the roll. Such means for engaging the roll may include a spindle extending through the central longitudinal aperture of the roll between the two arms, and engaging the two arms. Alternatively, conventional roll holders often use one boss on each arm for engaging only each end of the central longitudinal aperture of the roll. The rolls generally consist of a tubular core or sleeve upon which the paper is rolled up.

Conventional roll holders as described above present several difficulties in use. Roll holders which utilize a spindle which passes through the central longitudinal aperture of the roll material, engaging support arms on each end, are often difficult to replace. In order to position the roll on the holder, it is necessary to release one end of the spindle from one of the supports and then slide the core of the roll thereover. The loose end of the spindle is then reattached to its support. When the roll is used up, it is again necessary to release one end of the spindle, remove the core, and reposition another roll on the spindle which is again fixed in place. The specific means for removal and re-attachment of the spindle varies from prior art roll holder to roll holder, however, most require finely controlled hand motions to replace the paper roll. People who lack dexterity due to arthritis or other infirmities find it difficult to replace rolls on such conventional toilet paper roll holders. Further, replacing rolls on such roll holders usually requires the use of two hands.

Roll holders which use a boss, or short protrusion, to engage the end of the central longitudinal axis of the roll often fail to hold the roll in place when the end of the roll material is pulled firmly. For example paper towels are designed to tear at perforated tear lines when the free end of the paper is pulled with sufficient force. If the sheet does not tear from the roll along the perforated tear line, the entire roll may pull off of the roll holder, rather than a single sheet tearing free from the roll.

Another disadvantage to the prior art roll holders described above is that they are made for only one length of roll. If such a roll holder is made of one longitudinal size for use with toilet paper, it cannot also be used for holding hand towels of a different longitudinal size.

SUMMARY OF THE INVENTION

Accordingly, it is the general object of the present invention is to provide a roll holder on which the roll can be easily changed using one hand.

Another object is to provide a roll holder which requires no fine or delicate motions to maneuver the old roll off of the roll holder and to maneuver the new roll onto the roll holder.

It is a further object of the invention is to provide a roll holder which will not release the roll from the roll holder during use.

These and other objects of the invention will be apparent to those skilled in the art from the detailed description of the preferred embodiment of the invention below.

In accordance with the objectives of the present invention, the invention comprises two shafts, each having a pivot means on one end, and on the other end, a means for securing the shaft to a support structure such as a wall or cabinet either directly, or to a base plate which is secured to the support structure.

The invention further includes a pair of support arms having a first end pivotally coupled to the pivot means on each corresponding shaft, and a second end oriented pointing generally toward the support arm affixed to the pivot means of the other arm. The pivot means are formed so as to allow the support arms to pivot upward from horizontal. However, this is not the only orientation in which the present invention may be used.

The roll is held in place by inserting the support arms into the hollow center of the roll. In the orientation given above, gravity tends to keep the support arms in the horizontal position. The roll is free to rotate on its central longitudinal axis on the support arms. Material stored on the roll may be removed by pulling outwardly on the loose end of the material, causing the roll to turn axially on the support arms, allowing a desired amount of sheet-material to be unrolled. The roll of material is removed by pushing the roll upward, causing the support arms to rotate upward and out of the central longitudinal aperture of the roll.

Installation and removal of new rolls is easily accomplished. In the preferred orientation, during installation, the roll is held horizontally underneath the support arms. The roll is then moved upward against the support arms causing the support arms to pivot at the pivot point allowing the tips of the support arms to rotate upwardly until the top of the roll moves past the tips of the support arms, allowing the tips of the support arms to enter the central longitudinal aperture of the roll on each end. The roll is then allowed to move downward until the support arms are horizontal.

Still other objects and advantages of the present invention will become readily apparent to those skilled in this art from the following detailed description, wherein I have shown and described the preferred embodiment by way of illustration of the best mode of the invention. Where appropriate, other embodiments have been discussed, however, still further alternate embodiments without departing from the invention. Accordingly, the drawings and description are to be regarded as illustrative in nature, and not as restrictive.

BRIEF DESCRIPTION OF THE DRAWINGS

A preferred embodiment of the present invention is further described in connection with the accompanying drawings, in which.

DETAILED DESCRIPTION

Reference will now be made in detail to a presently preferred embodiment of the invention as illustrated in the accompanying drawings. The drawings show a roll holder according to the present invention, indicated generally by reference number 1.

Although the roll holder of the present invention may be used for holding any material which is stored on or dispensed from a roll, it is described here in its preferred embodiment for use with toilet paper rolls and paper hand towel rolls.

The preferred embodiment of the roll holder 1 as described herein contemplates a preferred orientation for use of the roll holder 1, however, other orientations are possible. References to up, down, vertical, horizontal, etc. should be understood to refer generally to the relative positions of the elements of the illustrated device, which could be otherwise oriented or positioned.

Figure 1:
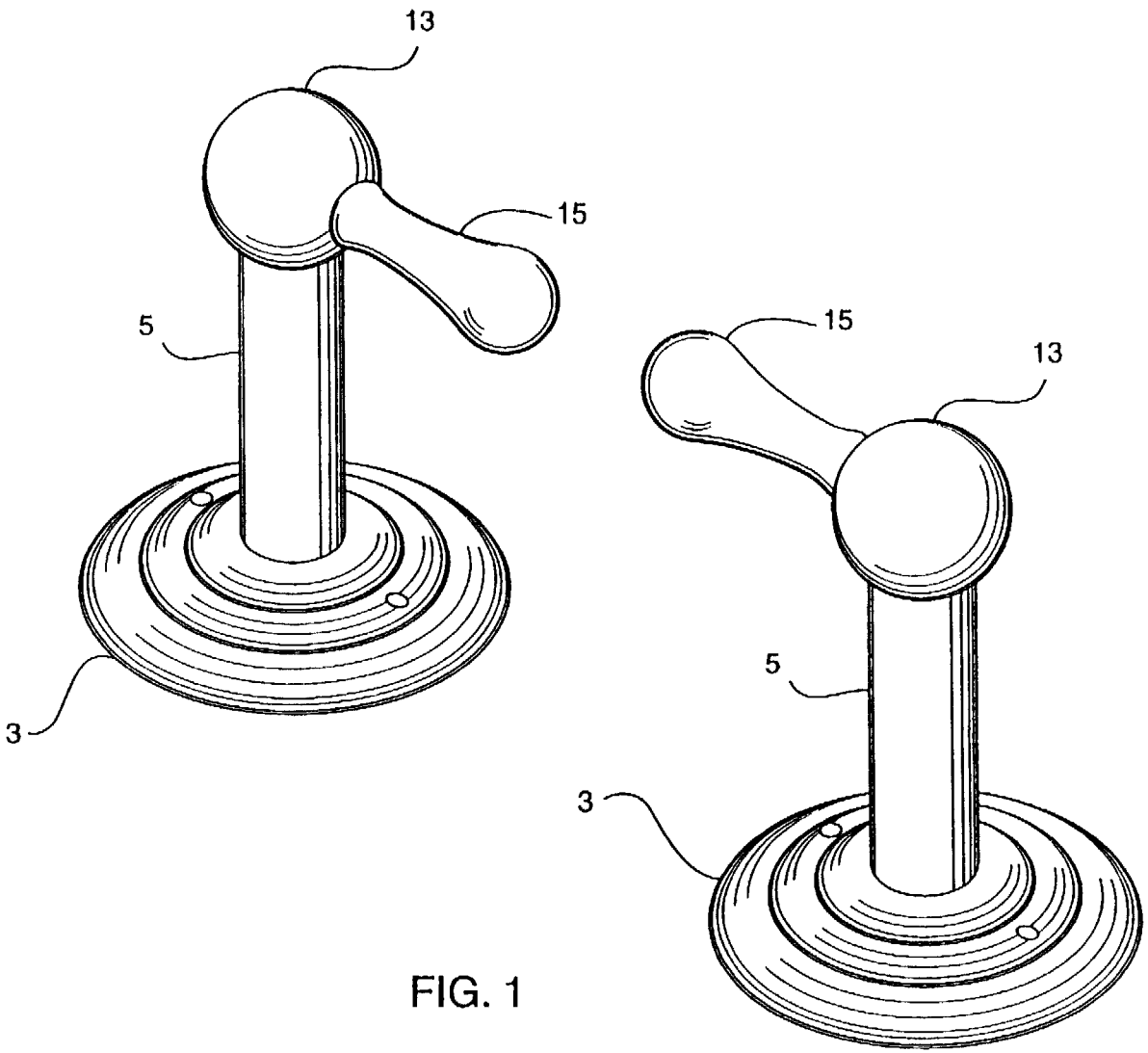
FIG. 1 shows a perspective view of the roll holder in accordance with the invention.
Figure 2:
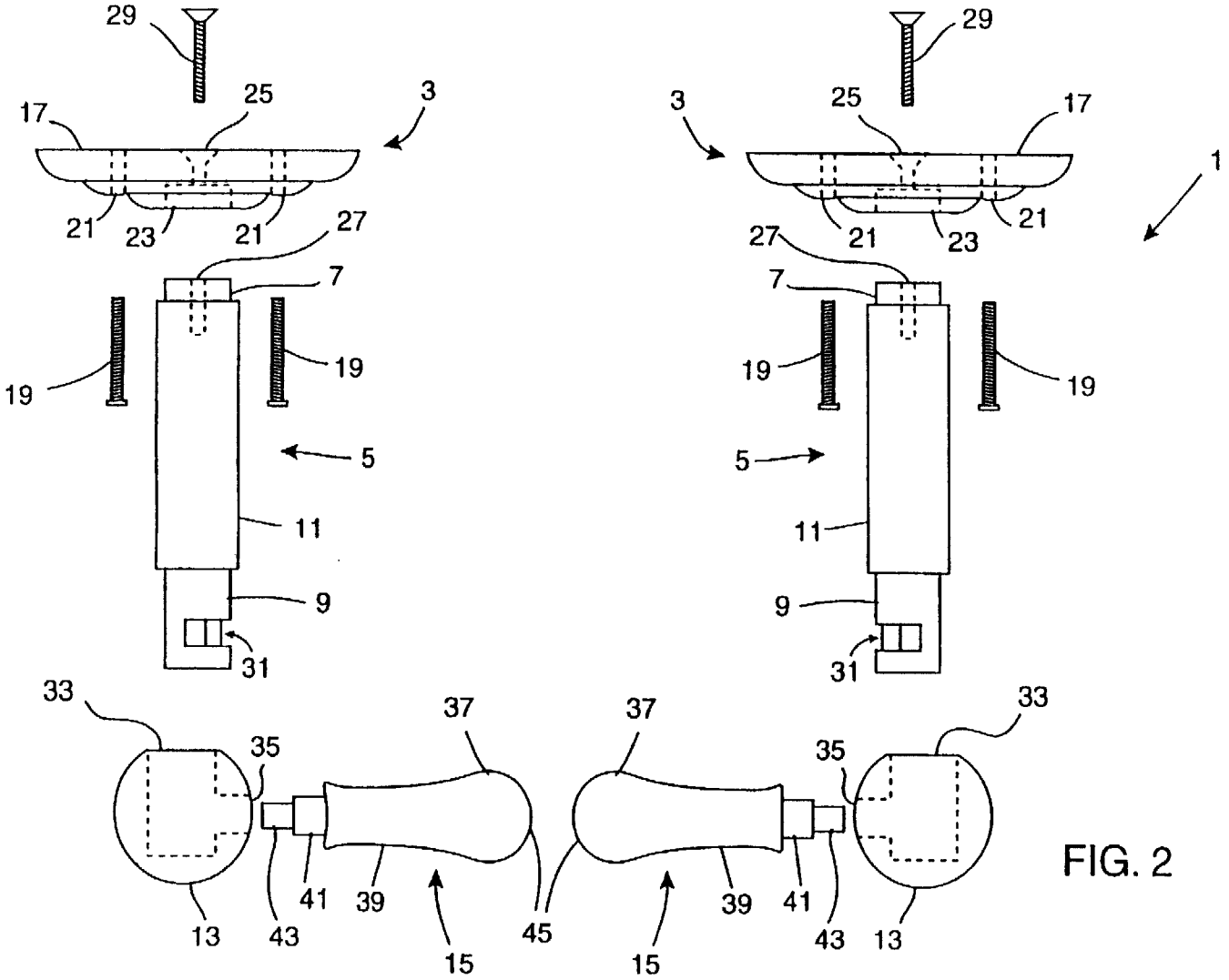
FIG. 2 shows a top plan view of the roll holder in accordance with the invention.

In the preferred embodiment, best seen in FIG. 2, the roll holder 1 comprises a pair of base plates 3 which are affixed to a support structure such as a wall. Coupled to each base plate is a shaft 6 having a base end 7, a pivot end 9, and a center portion 11. Each base end 7 is coupled to its corresponding base plate 3, and each pivot end 9 of each shaft 5 is pivotally coupled to a pivot structure 13. Each pivot structure 13 is further coupled to a support arm 15.

Figure 3:
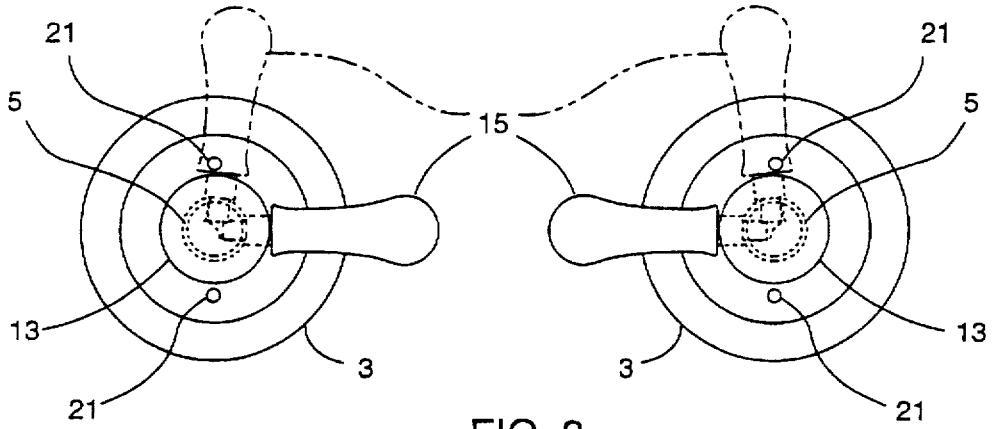
FIG. 3 shows a front plan view of the roll holder in accordance with the invention.
Figure 4:
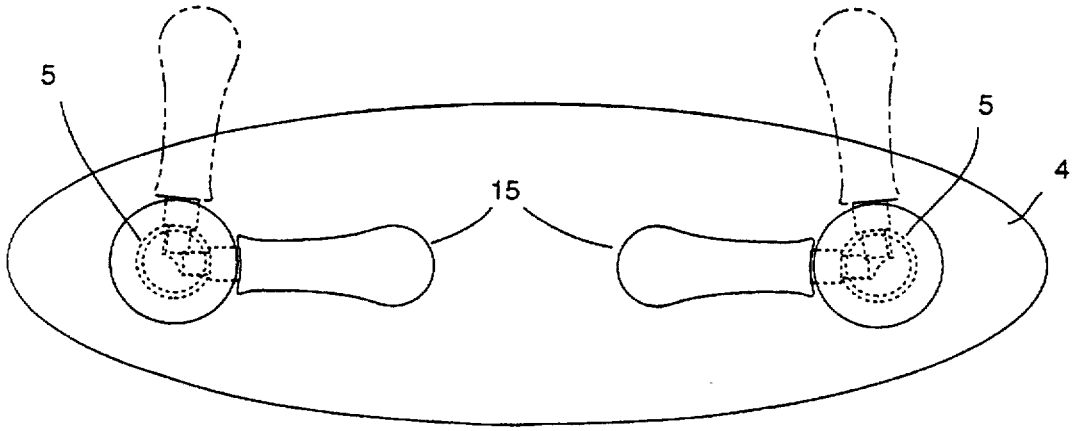
FIG. 4 shows a front plan view of the roll holder with a single base plate in accordance with an alternate embodiment of the present invention.

Referring to FIGS. 2 and 3, each base plate 3 includes a flat circular surface 17 on the bottom of base plate 3 for contact with a wall, cabinet, or other support structure. Each base plate 3 further includes a plurality of apertures 21 whereby base plate 3 can be secured to a support structure such as a wall or cabinet or other support structure by screws 19 extending through apertures 21 into the support structure. Each base plate 3 further includes a central recess 23 formed on the upper surface of each base plate 3 for accepting the complementary base end 7 of each corresponding shaft 5. A recess aperture 25 is formed in the bottom of recess 23 of base plate 3. Although base plates 3 are round in the preferred embodiment, any desirable shape may be used. In another alternate embodiment, shown in FIG. 4, a single larger base plate 4 may be used instead of two separate base plates 3.

Although, in the preferred embodiment, base plates 3 are secured to the support structure by a plurality of screws 19, base plates 3 may, alternatively, be secured by any desirable means such as adhesive, bolts, rivets, snaps, etc.

Shafts 5 are approximately 4 inches long, positioned substantially parallel in a horizontal plane, and spaced a distance apart approximately 1 inch wider than the length of the roll material to be held by roll holder 1. Base end 7 of each shaft 5 is adapted to be received in recess 23 of corresponding base plate 3. Base end 7 of shaft 5 further includes a threaded recess 27 located along the central axis of shaft 5 which threaded recess 27 is aligned with recess aperture 25 in the bottom of central recess 23 of each base plate 3. Shaft screw 29 passes through recess aperture 25 in base plate 3 and is threadably received into threaded recess 27, threadably coupling each shaft 5 to its corresponding base plate 3.

Figure 6B:
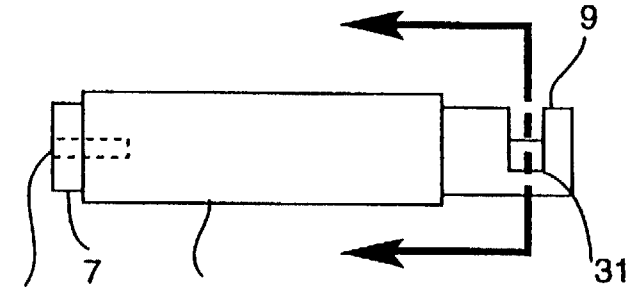
FIG. 6*b* shows a side plan view of a shaft portion of the roll holder.
Figure 6A:
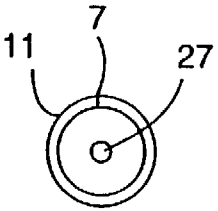
FIG. 6*a* shows a bottom plan view of a shaft portion of the roll holder.

Referring to FIGS. 6*a* and 6*b*, base end 7 of shaft 5 is cylindrical, having a diameter less than that of the center portion 11 of shaft 5. However, in alternate embodiments, not shown, base end 7 and center portion 11 could be any reasonable shape or size, in which case, central recess 23 would be formed to match.

Alternate means for coupling each shaft 5 to its corresponding base 3 are possible. For example, in an alternate embodiment, not shown, central recess 23 may be threaded, and base end 7 of shaft 5 formed with external screw threads and adapted so that the threaded base end would be threadably received within the threaded recess. Alternatively, an adhesive may be used, or the parts may be formed to be press fit or snap fit together.

In another alternate embodiment, not shown, shaft 5 may be directly coupled to the support structure, rather than being coupled to a base which is coupled to a support structure. Any known means for doing so may be used, for example, base end 7 of shaft 5 may form lateral flanges including apertures for securing shaft 5 directly to the support structure.

Pivot end 9 is cylindrical with a diameter less than that of the center portion 11 of shaft 5, and includes a pivot notch 31. Pivot notch 31 is wedge shaped having, when shaft 5 is oriented horizontally, a lower surface approximately 90 degrees from vertical, and an upper surface 20 degrees from vertical, and sides which are in a plane substantially radial to the central longitudinal axis of shaft 5. In alternate embodiments, not shown, the elements listed above could be oriented differently.

Figure 5B:
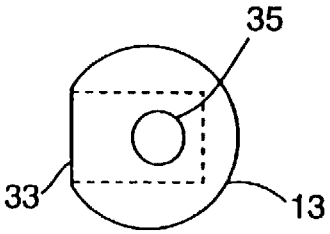
FIG. 5*b* shows a side plan view of the pivot structure portion of the roll holder.
Figure 5A:
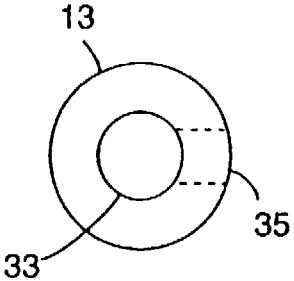
FIG. 5*a* shows a back plan view of the pivot structure portion of the roll holder.

Each pivot structure 13, best seen in FIGS. 5*a* and 5*b*, is substantially spherical, however, other shapes are possible, including but not limited to square, or cylindrical pivot structures. Pivot structure 13 includes a pivot recess 33, formed to receive pivot end 9 of shaft 5, and support arm bore 35 which passes from the outside surface of pivot structure 13 to pivot structure recess 33. When pivot structure 13 is properly positioned with pivot end 9 of shaft 5 inserted into pivot structure recess 33, threaded support arm bore 35 is aligned with pivot notch 31.

Although the preferred pivot means is describe above, any known means for allowing support arms 15 to pivot may be used, for example, in an alternate embodiment not shown in any figure, hinges may be used.

Figure 7:
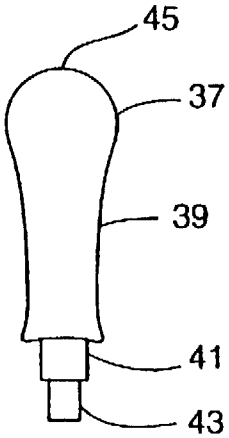
FIG. 7 shows a side plan view of a support arm portion of the roll holder.
Figure 6C:
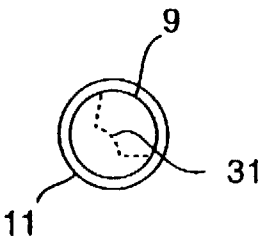
FIG. 6*c* shows a top plan view of a shaft portion of the roll holder.

Referring to FIGS. 2 and 7, support arms 15 are formed having a bulbous arm portion 37 formed having a neck 39 which swells in diameter towards a blunt tip 45, a cylindrical threaded base 41, and a cylindrical pin 43. Bulbous arm portion 37 is preferably approximately 2 inches long. Cylindrical threaded base 41 of each support arm 15 is threadably received in the threaded support arm bore 35 of its corresponding pivot structure 13, thereby coupling each support arm 15 to its corresponding pivot structure 13. When support arm 15 is coupled to pivot structure 13, cylindrical pin 43 extends into pivot notch 31.

In alternate embodiments not shown, the bulbous portion 37 of support arms 15 could be any shape suitable for the purpose. Further, in alternative embodiments, threaded base 41 could instead be adhesively affixed in threaded support arm bore 35, or threaded base 41 could be formed so as to be press fit or snap fit in place.

When assembled, each support arm 15 is rotatable axially around the central axis of corresponding shaft 5, in the preferred embodiment, from horizontal to 20 degrees from vertical. Gravity tends to urge the support arms 15 downward. Downward motion of each support arm 15 is stopped when cylindrical pin 43 contacts the lower wall of corresponding pivot notch 15. Each support arm 15 can be rotated upwardly until its cylindrical pin 43 contacts the upper wall of pivot notch 31.

The roll is held in place by inserting the support arms 15 into the central longitudinal aperture of the roll, or alternatively, into cavities formed in each end of the roll. The roll is free to rotate axially on the support arms 15. In the preferred embodiment, gravity and the weight of the roll tends to keep the support arms 15 in the horizontal position.

Material stored on the roll may be removed by pulling outwardly on the loose end of the material, causing the roll to turn axially on the support arms 15, allowing a desired amount of sheet-material to be unrolled. The roll of material is removed by pushing the roll upward, causing the blunt ends 45 of each support arm 15 to rotate upward and out of the central longitudinal aperture of the roll.

Installation and removal of new rolls is easily accomplished. During installation, the roll is held horizontally underneath the support arms 15, with the central axis of the roll substantially aligned with the shared central axis of support arms 15. The roll is then moved upward against the support arms 15 causing the blunt ends 45 of support arms 15 to rotate upwardly until the top of the roll moves past the blunt ends 45 of support arms 15, allowing the blunt ends of support arms 15 to enter the central longitudinal aperture of the roll on each end. The roll is then allowed to move downwardly until support arms 15 are horizontal. Further downward motion of support arms 15 is stopped by contact of cylindrical pin 43 with the bottom surface of pivot notch 31.

The roll holder 1 of the present invention can be used in orientations other than horizontal. In such cases, springs, or other methods of providing a continuing force may be used, instead of gravity, to urge the support arms 15 into the proper alignment for holding the roll.

Roll holder 1 can be used on any length roll. The shafts 5 of roll holder 1 are coupled to the support structure a distance approximately 1 inch further apart that the length of the roll which the roll holder 1 is intended to hold. Thus, for example, there is no need to manufacture different roll holders for use with toilet paper, paper towels, plastic wrap, gift wrapping paper, etc. One size may be used for any of the mentioned purposes.

In its preferred embodiment, roll holder 1 is made of aluminum or wood, however, many other materials may be used including other metals, plastic, and polyvinylchloride.

While the above description contains many specificities, the examples given should not be construed as limitations on the scope of the invention, but merely as exemplifications of preferred embodiments thereof. Additional advantages and modifications will readily occur to those skilled in the art. The invention in its broader aspects is therefore not limited to the specific details, representative apparatus and illustrative examples shown and described. Accordingly it should be apparent to those skilled in the art that variations and modifications are possible without departing from the spirit of the invention.

What is claimed is:

1. An apparatus attachable to a supporting surface for holding and dispensing material stored on a roll, the apparatus comprising:

a first and a second support member, each support member having a first end and a second end, said second end of each said support member including a recess;

a means for securing said first end of each said support member to the supporting surface;

a first pivot comprising a first pivot body having a support member aperture sized to receive said second end of said first support member, and a support arm aperture sized to receive a base end of a first support arm, said support arm aperture of said first pivot body being aligned with said recess of said first support member;

said first support a further comprising a first end, said base end of said first support arm further comprising a protrusion, said base end of said first support arm being received within said support arm aperture of said pivot body, and said protrusion being received within said recess of said first support member; and a second pivot comprising a second pivot body having support member aperture sized to receive said second end of said second support member, and a support arm aperture sized to receive a base end of a second support arm, said support arm aperture of said second pivot body being aligned with said recess of said second support member;

said second support arm farther comprising a first end, said base end of said second support arm further comprising a protrusion, said base end of said second support arm being received within said support arm aperture of said second pivot body, and said protrusion being received within said recess of said second support member within a range limited by said protrusion within said recess of each said support member.

2. The apparatus according to claim 1 wherein said first and second support members are attached to the support surface a predetermined distance apart.

3. The apparatus according to claim 1 wherein said support members are aligned substantially co-planar with each other.

4. The apparatus according to claim 1 wherein said means for securing said support members to the supporting surface comprises a pair of bases adapted to be secured to the supporting surface.

5. The apparatus according to claim 1 wherein said means for securing said support members to the supporting surface comprises a single base plate adapted to be secured to the supporting surface.

6. The apparatus of claim 1 wherein said first end of each said first and second support arm comprises a bulbous arm portion, said bulbous arm portion of each said first and second support arm comprising a neck portion having a first diameter, and a rounded having a second diameter larger than said first diameter.

7. The apparatus of claim 6, wherein each said first and second support arm has a central longitudinal axis.

8. The apparatus according to claim 7, wherein each said first and second support arm has a first position, and wherein said central longitudinal axes of said first support arm is substantially aligned with said central longitudinal axes of said second support arm in said first position.

9. The apparatus according to claim 6, wherein each said neck portion of each said support arm has a diameter which increases towards said rounded end of said support arm.

10. The apparatus of claim 1, wherein said recess of each said first and second support member comprises an upper wall and a lower wall, and wherein said upper and lower walls define an acute angle.

11. The apparatus of claim 1, wherein each said support arm is adhesively fixed to its said pivot body.

12. The apparatus of claim 1, wherein each said support arm aperture on each said pivot is threaded, and wherein each said first and second support arm is threadably received within its said threaded support arm aperture.

13. The apparatus of claim 1, wherein each said first and second support arm is upwardly rotatable less than 90 degrees from horizontal, defining a range of rotation of each said first and second support arm, whereby each said first and second support arm is urged downward by gravity from any position within said range of rotation of each of said first and second support arm.

14. The apparatus of claim 13, wherein each said first and second support arm further comprises a center of gravity located closer to said first end of each said first and second support arm than to said base portion of each first and second support arm, whereby downward urging by gravity of each said first and second support arm is facilitated.

15. An apparatus attachable to a supporting surface for holding and dispensing material stored on a roll, the apparatus comprising:

a first and a second support member, each support member having a first end and a second end, said second end of each said support member includes a recess, each recess having a substantially horizontal lower wall, and an upper wall;

a means for securing said first end of each said support member to the supporting surface;

a first pivot comprising a first pivot body having a support member aperture sized to receive said second end of said first support member, and a support arm aperture sized to receive a base end of a first sport arm, said support arm aperture of said first pivot body being aligned with said recess of said first support member;

said first support arm further comprising a central longitudinal axis, and a first end comprising a neck portion and a rounded tip portion, said base end of said first support arm further comprising a protrusion, said base end of said first support arm being received within said support arm aperture of said first pivot body, and said protrusion being received within said recess of said first support member, and said first end of said first support arm being upwardly rotatable less than 90 degrees from horizontal;

a second pivot comprising a second pivot body having a support member aperture sized to receive said second end of said second support member, and a support arm aperture sized to receive a base end of a second support arm, said support arm aperture of said second pivot body being aligned with said recess of said second support member; and said second support arm further comprising a central longitudinal axis, a first end comprising a neck portion and a rounded tip portion, said base end of said second support arm further comprising a protrusion, said base end of said second support arm being received within said support arm aperture of said second pivot body, and said protrusion being received within said recess of said second support member, and said first end of said second support arm being upwardly rotatable less than 90 degrees from horizontal; and whereby each support arm is free to rotate around the central longitudinal axis of each said support member within a range limited by said protrusion within said recesses of each said support member, and whereby each support arm is urged to a horizontal position by gravity from any position within each said arms range of movement.

* * * * *